US010422336B2

(12) United States Patent
Ogawa et al.

(10) Patent No.: US 10,422,336 B2
(45) Date of Patent: Sep. 24, 2019

(54) CYLINDER ROTARY COMPRESSOR HAVING AN INLET OF THE ROTOR-SIDE SUCTION PASSAGE OPENED AT THE ROTOR-SIDE CONCAVE PORTION AND COMMUNICATING WITH A ROTOR-SIDE COMMUNICATION SPACE THEREIN

(71) Applicant: DENSO CORPORATION, Kariya, Aichi-pref. (JP)

(72) Inventors: Hiroshi Ogawa, Nishio (JP); Yoshinori Murase, Kariya (JP)

(73) Assignee: DENSO CORPORATION, Kariya (JP)

( * ) Notice: Subject to any disclaimer, the term of this patent is extended or adjusted under 35 U.S.C. 154(b) by 253 days.

(21) Appl. No.: 15/529,732

(22) PCT Filed: Dec. 15, 2015

(86) PCT No.: PCT/JP2015/006250
§ 371 (c)(1),
(2) Date: May 25, 2017

(87) PCT Pub. No.: WO2016/103635
PCT Pub. Date: Jun. 30, 2016

(65) Prior Publication Data

US 2017/0350393 A1 Dec. 7, 2017

(30) Foreign Application Priority Data

Dec. 23, 2014 (JP) ..... 2014-259573

(51) Int. Cl.
*F03C 2/00* (2006.01)
*F03C 4/00* (2006.01)
(Continued)

(52) U.S. Cl.
CPC ..... *F04C 18/3564* (2013.01); *F04C 18/3441* (2013.01); *F04C 23/02* (2013.01);
(Continued)

(58) Field of Classification Search
CPC .... F04C 23/001; F04C 23/02; F04C 18/3441; F04C 18/348; F04C 18/3564; F04C 2/348;
(Continued)

(56) References Cited

U.S. PATENT DOCUMENTS 984,061 A * 2/1911 Augustine ..... F04C 2/344 418/146
2,100,014 A * 11/1937 McCracken ..... F04C 2/344 418/185
(Continued)

FOREIGN PATENT DOCUMENTS

JP S63-065832 B2 12/1988
JP 2012-117476 A 6/2012
JP 2012-255438 A 12/2012

*Primary Examiner* — Theresa Trieu
(74) *Attorney, Agent, or Firm* — Posz Law Group, PLC

(57) ABSTRACT

In a cylinder rotary compressor, a shaft-side suction passage for circulation of a refrigerant is formed within a shaft that rotatably supports a rotor. A rotor-side suction passage is provided within the rotor so as to guide the refrigerant flowing out of shaft-side outlets formed at the outer peripheral surface of the shaft to a compression chamber. Furthermore, a rotor-side concave portion is formed at an inner peripheral surface of the rotor. A space provided within the rotor-side concave portion forms a rotor-side communication space with an appropriate shape and a capacity enough to make the shaft-side outlets communicate with a rotor-side inlet of the rotor-side suction passage, regardless of the rotation of the rotor.

6 Claims, 7 Drawing Sheets

(51) Int. Cl.

| | |
|---|---|
| ***F04C 2/00*** | (2006.01) |
| ***F04C 18/356*** | (2006.01) |
| ***F04C 23/02*** | (2006.01) |
| ***F04C 29/00*** | (2006.01) |
| ***F04C 29/12*** | (2006.01) |
| ***F04C 18/344*** | (2006.01) |

(52) U.S. Cl.
CPC ..... *F04C 29/0057* (2013.01); *F04C 29/12* (2013.01); *F04C 2230/60* (2013.01); *F04C 2240/10* (2013.01); *F04C 2240/20* (2013.01); *F04C 2240/30* (2013.01); *F04C 2240/40* (2013.01); *F04C 2240/60* (2013.01); *F04C 2240/603* (2013.01); *F04C 2250/10* (2013.01)

(58) Field of Classification Search
CPC ..... F04C 29/0057; F04C 29/12; F04C 2240/603; F04C 2240/60; F04C 2240/40; F04C 2240/30; F04C 2240/20; F04C 2240/10; F04C 2230/60; F04C 2250/10; F04C 2250/20
USPC ..... 418/13, 93, 94, 145–148, 173, 183, 418/187–188
See application file for complete search history.

(56) References Cited

U.S. PATENT DOCUMENTS

| | | | | |
|---|---|---|---|---|
| 2,420,124 | A * | 5/1947 | Coulson | F04C 18/348 418/173 |
| 2,440,593 | A * | 4/1948 | Miller | F04C 18/348 418/173 |
| 2,551,623 | A * | 5/1951 | More | F04C 29/02 418/94 |
| 2009/0081063 | A1 * | 3/2009 | Kemp | F04C 2/3442 418/145 |
| 2012/0076678 | A1 | 3/2012 | Yamashita | |
| 2012/0134864 | A1 | 5/2012 | Lee et al. | |
| 2015/0176583 | A1 | 6/2015 | Murase et al. | |
| 2016/0115957 | A1 | 4/2016 | Murase et al. | |

* cited by examiner

CYLINDER ROTARY COMPRESSOR HAVING AN INLET OF THE ROTOR-SIDE SUCTION PASSAGE OPENED AT THE ROTOR-SIDE CONCAVE PORTION AND COMMUNICATING WITH A ROTOR-SIDE COMMUNICATION SPACE THEREIN

CROSS REFERENCE TO RELATED APPLICATIONS

The present application is a U.S. national stage of International Patent Application No. PCT/JP2015/006250 filed on Dec. 15, 2015 and is based on Japanese Patent Application No. 2014-259573 filed on Dec. 23, 2014, the contents of which are incorporated herein by reference in its entirety.

FIELD OF THE INVENTION

The present invention relates to a cylinder rotary compressor that rotates a cylinder to form a compression chamber therein.

BACKGROUND ART

Conventionally, there is known a cylinder rotary compressor that rotates a cylinder to form a compression chamber therein to change the capacity of the compression chamber, thereby compressing and discharging a fluid.

For example, Patent Document 1 discloses a cylinder rotary compressor that includes a cylindrical cylinder integrally formed with a rotation part of an electromotor (electric motor), a rotor disposed in the cylinder and formed of a cylindrical member, and vanes slidably fitted into grooves (slits) formed in the rotor to partition the compression chamber.

In this type of cylinder rotary compressor, the cylinder and the rotor rotate around different rotary shafts while interlocking with each other, thereby displacing the vanes to change the capacity of the compression chamber. The cylinder rotary compressor of Patent Document 1 is designed to include a compression mechanism on the inner circumferential side of the electric motor, thereby achieving the downsizing of the entire compressor.

RELATED ART DOCUMENT

Patent Document

[Patent Document 1] Japanese Unexamined Patent Application Publication No. 2012-67735

SUMMARY OF INVENTION

Based on the studies by the inventors of the present application, the cylinder rotary compressor described in Patent Document 1 is configured such that a part of a suction passage for guiding a fluid to be compressed, drawn from the outside, to the compression chamber is formed in a side plate that closes one end in the axial direction of the cylinder. However, as the side plate rotates with the cylinder, the passage structure or seal structure of the suction passage is more likely to be complicated when a part of the suction passage is formed in the side plate.

In contrast, the inventors have previously proposed the internal configuration of a shaft by which a rotor is rotatably supported, as well as a cylinder rotary compressor including a suction passage formed in the rotor in Japanese Patent Application No. 2013-119924 (hereinafter referred to as a previous application example).

More specifically, the previous application example has proposed a cylinder rotary compressor that has a shaft-side suction passage formed in the shaft and a rotor-side suction passage formed in the rotor. The shaft-side suction passage allows for circulation of a fluid to be compressed that is drawn from the outside of the compressor. The rotor-side suction passage guides the fluid to be compressed flowing out of the shaft-side suction passage to the compression chamber side. Thus, the fluid to be compressed can be guided to the compression chamber without complicating the passage structure or sealing structure of the suction passage.

In the cylinder rotary compressor of the previous application example, an outlet of the shaft-side suction passage is opened at an outer peripheral surface of the shaft, while an inlet of the rotor-side suction passage is opened at an inner peripheral surface of the rotor.

Thus, a communication area that is effective in circulating the fluid to be compressed from the shaft-side suction passage to the rotor-side suction passage tends to change, when the rotor rotates with respect to the shaft to change the relative position of the outlet of the shaft-side suction passage to the inlet of the rotor-side suction passage. Furthermore, when the communication area becomes small, the loss of suction pressure in drawing the fluid to be compressed into the compression chamber might increase to degrade the pressurizing performance of the compressor.

To suppress the degradation in such pressurizing performance, the outer peripheral surface of the shaft is recessed toward its inner peripheral side to form a communication space that constantly communicates with both the outlet of the shaft-side suction passage and the inlet of the rotor-side suction passage.

Nevertheless, when the shaft diameter is increased to sufficiently ensure the capacity of the communication space, the entire compressor could be increased in size. On the other hand, when the amount of a recessed part of the outer peripheral surface of the shaft is increased without enlarging the shaft diameter, the strength of the recessed part might become insufficient. Thus, when the outer peripheral surface of the shaft is recessed toward its inner peripheral side so as to form the communication space, it is difficult to form the communication space with an appropriate capacity.

The present invention has been made in view of the foregoing matters, and it is an object to provide a cylinder rotary compressor that can suppress an increase in the loss of the suction pressure without increasing the size thereof.

A cylinder rotary compressor includes: a cylindrical cylinder configured to rotate around a central axis; a cylindrical rotor disposed in the cylinder and configured to rotate around an eccentric axis that is eccentric to the central axis of the cylinder; a shaft rotatably supporting the rotor; and a vane slidably fitted into a groove provided in the rotor and partitioning a compression chamber formed between an outer peripheral surface of the rotor and an inner peripheral surface of the cylinder. A shaft-side suction passage is provided within the shaft, in which a fluid to be compressed, flowing from an outside, is circulated. An outlet of the shaft-side suction passage is opened at an outer peripheral surface of the shaft, and a rotor-side suction passage is provided within the rotor, through which the fluid to be compressed, flowing out of the outlet, is guided from an inner peripheral side of the rotor to the compression chamber. Furthermore, a rotor-side concave portion is provided at an inner peripheral surface of the rotor by recessing the inner peripheral surface of the rotor toward an outer peripheral side, and an inlet of the rotor-side suction passage is opened at a part of the rotor, where the rotor-side concave portion is formed, to communicate with a rotor-side communication space that is provided within the rotor-side concave portion.

Thus, the rotor-side communication space is formed within the rotor-side concave portion. Therefore, even when the relative position of the outlet of the shaft-side suction passage to the inlet of the rotor-side suction passage changes together with the rotation of the rotor, the outlet of the shaft-side suction passage can communicate with the inlet of the rotor-side suction passage via the rotor-side communication space.

Since the outer diameter of the rotor is formed to be relatively larger than that of the shaft, the capacity of the rotor-side communication space can be easily formed to be larger than that of the communication space formed by recessing the outer peripheral surface of the shaft toward its inner peripheral side. Therefore, the rotor-side communication space can be formed to have the capacity enough to appropriately communicate the outlet of the shaft-side suction passage with the inlet of the rotor-side suction passage without an increase in the entire size of the compressor.

Consequently, the cylinder rotary compressor suppresses an increase in the loss of the suction pressure without increasing the entire size of the compressor.

The rotor-side concave portion is not limited to one formed across the entire periphery of the inner peripheral surface of the rotor, but may be one formed at a part of the inner peripheral surface of the rotor. Furthermore, the rotor-side concave portion is not limited to one formed with a constant depth in the radial direction, but may be one that is shaped to vary its depth in the radial direction.

DESCRIPTION OF EMBODIMENTS

One embodiment of the present invention will be described below with reference to the accompanying drawings. A cylinder rotary compressor 1 (hereinafter simply referred to as a "compressor 1") of the present embodiment is applied to a vapor-compression refrigeration cycle device that is designed to cool ventilation air to be blown into a vehicle interior by a vehicle air conditioner. The compressor 1 serves to compress and discharge a refrigerant as a fluid to be compressed in the refrigeration cycle device.

Figure 1:
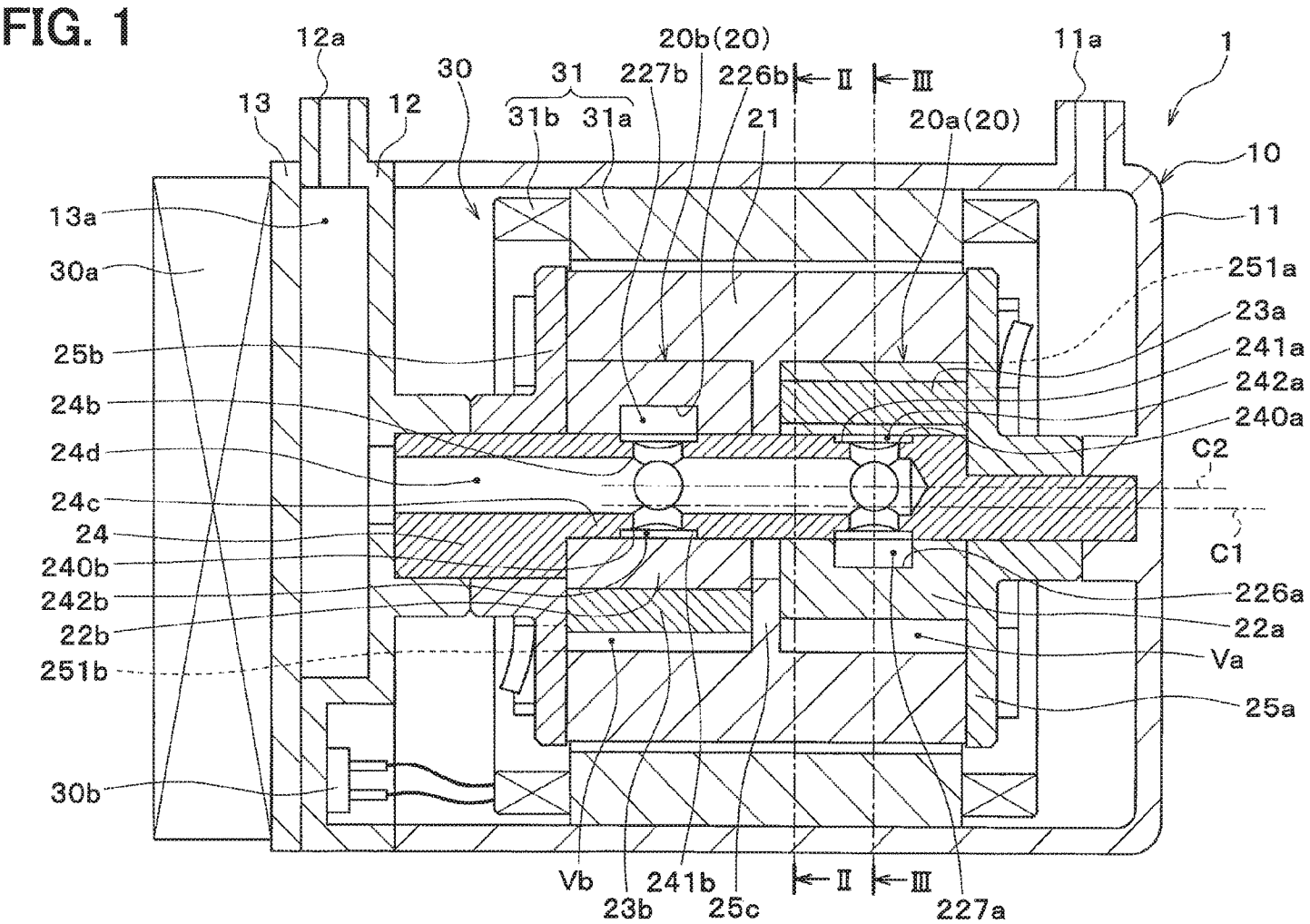
FIG. 1 is a sectional view in the axial direction of a compressor in one embodiment.

As shown in FIG. 1, the compressor 1 is configured as an electric compressor that accommodates a compression mechanism 20 and an electromotor (electric motor) 30 within a housing 10 forming an outer envelope of the compressor. The compression mechanism 20 compresses and discharges a refrigerant. The electromotor 30 drives the compression mechanism 20.

The housing 10 is configured by combining a plurality of metal members and has an airtight container structure that forms a substantially columnar space therein.

As shown in FIG. 1, more specifically, the housing 10 is configured by combining a bottomed cylindrical (cup-shaped) main housing 11, a bottomed cylindrical sub-housing 12 disposed to close an opening of the main housing 11, and a disc-shaped lid 13 disposed to close an opening of the sub-housing 12.

Seal members (not shown), such as an O-ring, are interposed at abutting parts among the main housing 11, sub-housing 12, and lid 13, thereby preventing the refrigerant from leaking from the respective abutting parts.

A discharge port 11*a* is formed at the cylindrical side surface of the main housing 11 so as to discharge a high-pressure refrigerant pressurized by the compression mechanism 20 toward the outside of the housing 10 (specifically, to the refrigerant inlet side of a condenser in the refrigeration cycle device). A suction port 12*a* is formed at the cylindrical side surface of the sub-housing 12 so as to draw a low-pressure refrigerant from the outside of the housing 10 (specifically, the low-pressure refrigerant flowing out of an evaporator in the refrigeration cycle device).

A housing-side suction passage 13*a* is formed between the sub-housing 12 and the lid 13. The housing-side suction passage 13*a* guides the low-pressure refrigerant drawn from the suction port 12*a* to first and second compression chambers Va and Vb of the compression mechanism 20. Furthermore, a drive circuit (inverter) 30*a* for supplying power to the electromotor 30 is attached to one surface of the lid 13 opposite to the other surface thereof on the sub-housing 12 side.

The electromotor 30 has a stator 31 serving as a stator of the motor. The stator 31 includes a stator core 31*a* formed of metallic magnetic material, and a stator coil 31*b* wound around the stator core 31*a*. The stator 31 is fixed to the inner peripheral surface of the cylindrical side surface of the main housing 11 by means, such as press-filling.

When power is supplied from the drive circuit 30*a* to the stator coil 31*b* via a sealed terminal (hermetic seal terminal) 30*b*, a rotating magnetic field is generated to rotate a cylinder 21 disposed on the inner peripheral side of the stator 31 as will be described later. The cylinder 21 is made of a cylindrical metallic magnetic material to form the compression chamber of the compression mechanism 20 as will be described later.

Figure 2:
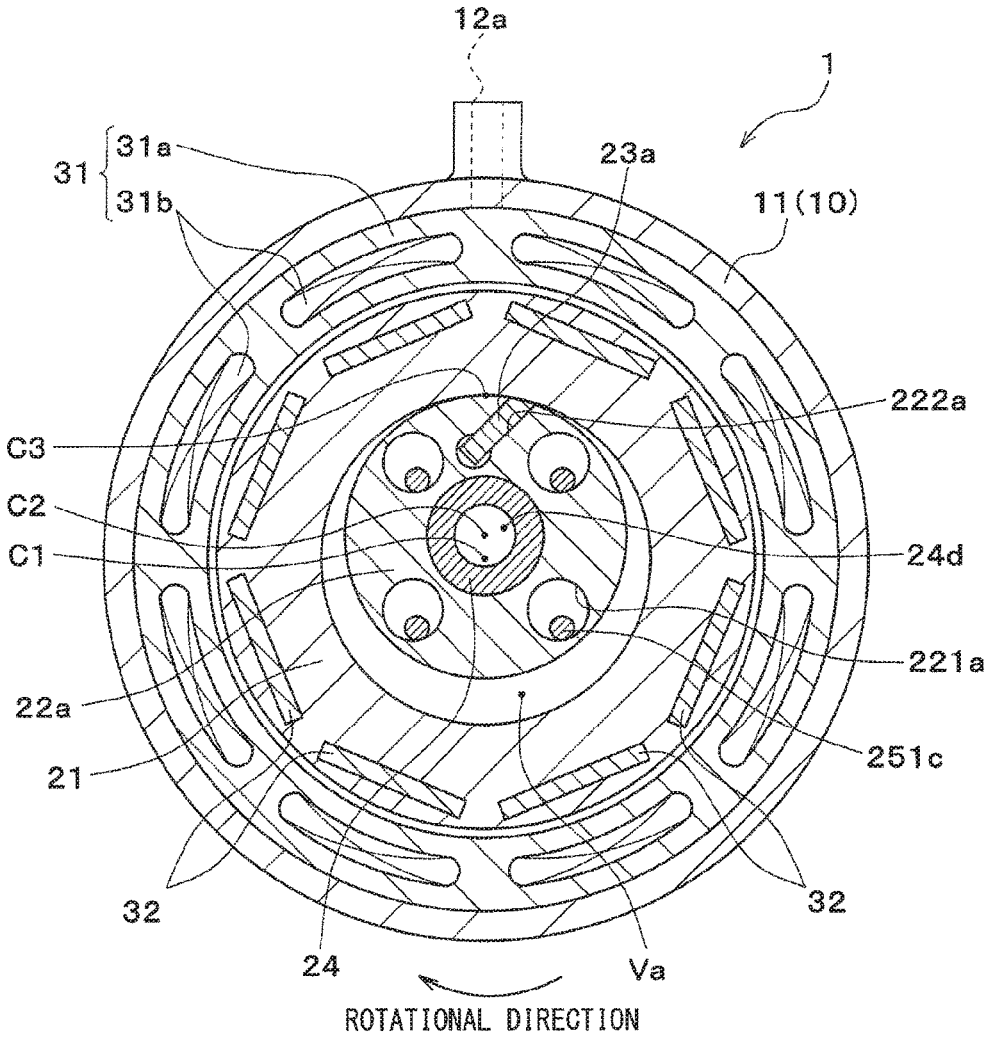
FIG. 2 is a cross-sectional view taken along the line II-II of FIG. 1.
Figure 3:
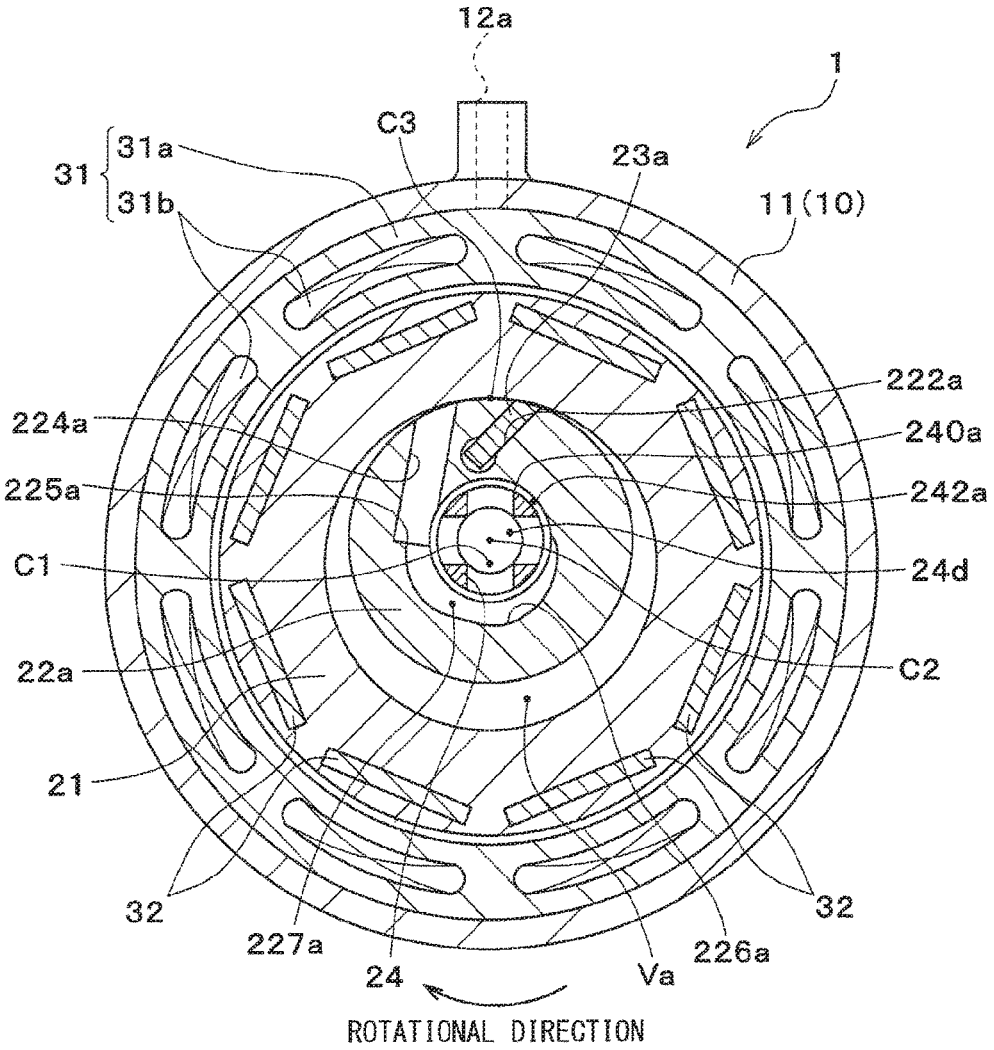
FIG. 3 is a cross-sectional view taken along the line III-III of FIG. 1.

As shown in the cross-sectional views of FIGS. 2 and 3, magnets (permanent magnets) 32 are fixed to the cylinder 21. Thus, the cylinder 21 also serves as a rotor part of the electromotor 30. The cylinder 21 rotates around a center axis C1 by the rotating magnetic field generated by the stator 31.

That is, in the compressor 1 of the present embodiment, the rotor part of the electromotor 30 and the cylinder 21 of the compression mechanism 20 are integrally formed. Obviously, the rotor part of the electromotor 30 and the cylinder 21 of the compression mechanism 20 may be formed by different members and then be integrated together by means, such as press-fitting.

Next, the compression mechanism 20 will be described. In the present embodiment, the compression mechanism 20 includes two mechanisms, namely, a first compression mechanism 20*a* and a second compression mechanism 20*b*. The first and second compression mechanisms 20*a* and 20*b* have substantially the same basic structure. The first and second compression mechanisms 20*a* and 20*b* are connected in parallel to the refrigerant flow within the housing 10.

As shown in FIG. 1, the first and second compression mechanisms 20*a* and 20*b* are arranged in parallel with the axial direction of the cylinder 21. In the present embodiment, one of two compression mechanisms disposed on the bottom side of the main housing 11 is the first compression mechanism 20*a*, and the other disposed on the sub-housing 12 side is the second compression mechanism 20*b*.

Figure 4:
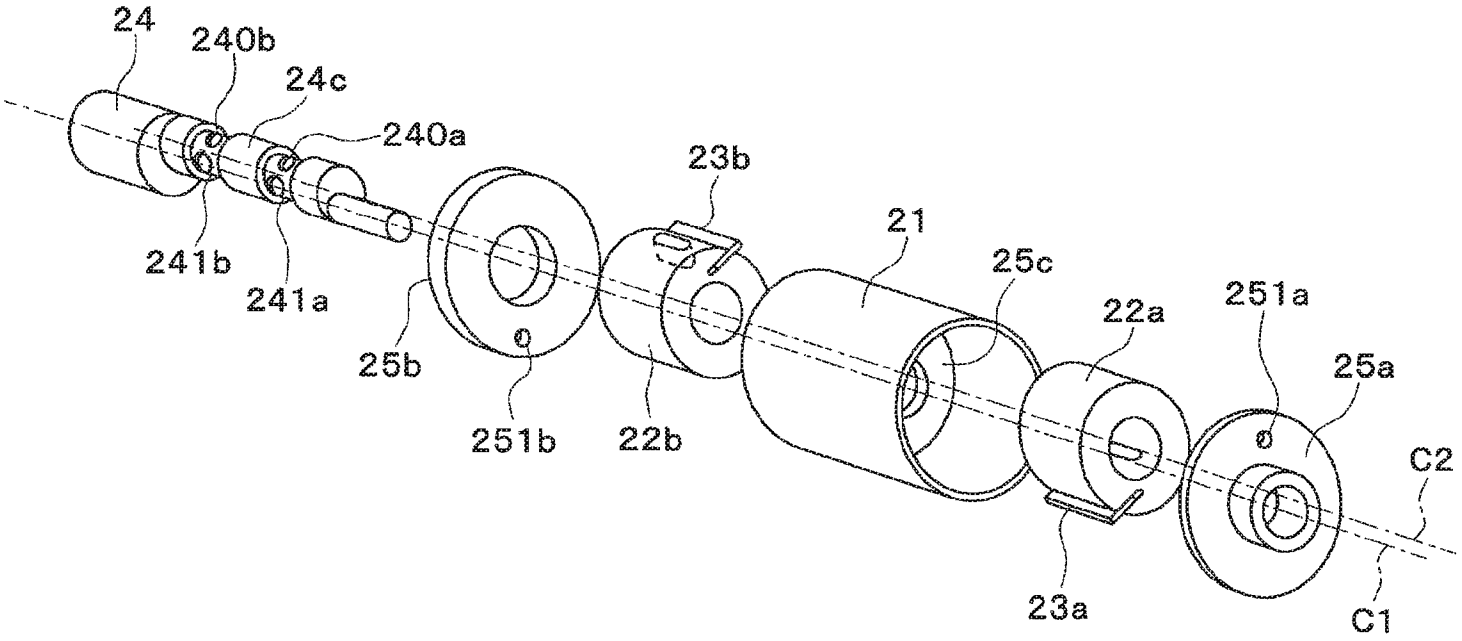
FIG. 4 is an exploded perspective view of a compression mechanism of the compressor in the one embodiment.

In FIGS. 1 and 4, components of the second compression mechanism 20*b* equivalent to those of the first compression mechanism 20*a* are denoted by respective reference characters with the last alphabetical letter changed from "a" to "b". For example, a second rotor as one of the components of the second compression mechanism 20*b* corresponding to a first rotor 22*a* of the first compression mechanism 20*a* will be given reference character "22*b*".

The first compression mechanism 20*a* includes the above-mentioned cylinder 21, the first rotor 22*a*, a first vane 23*a*, and a shaft 24. Here, as can be clearly seen from FIG. 1, parts of the cylinder 21 and the shaft 24 on the bottom side of the main housing 11 form the first compression mechanism 20*a*, while other parts thereof on the sub-housing 12 side form the second compression mechanism 20*b*.

The cylinder 21 is a cylindrical member that rotates around the central axis C1 as the rotor part of the electromotor 30 and which forms therein the first compression chamber Va of the first compression mechanism 20*a* as well as the second compression chamber Vb of the second compression mechanism 20*b*.

First and second side plates 25*a* and 25*b* serving as closing members for closing the openings of the cylinder 21 are fixed to both ends in the axial direction of the cylinder 21. Each of the first and second side plates 25*a* and 25*b* has a disc-shaped portion expanding in the direction substantially perpendicular to the rotary shaft of the cylinder 21, and a boss portion disposed at the center of the disc-shaped portion and protruding in the axial direction. The boss portion is provided with a through hole passing through each of the first and second side plates 25*a* and 25*b*.

A bearing mechanism (not shown) is disposed in each of the through holes. The shaft 24 is inserted into the bearing mechanism, thereby rotatably supporting the cylinder 21 with respect to the shaft 24. Both ends of the shaft 24 are respectively fixed to the housing 10 (specifically, the main housing 11 and the sub-housing 12). Thus, the shaft 24 never rotates with respect to the housing 10.

The cylinder 21 in the present embodiment forms therein the first compression chamber Va and the second compression chamber Vb that are separated from each other. A disc-shaped intermediate side plate 25*c* for separating the first compression chamber Va from the second compression chamber Vb is disposed in the cylinder 21. The intermediate side plate 25*c* also has the same function as the first and second side plates 25*a* and 25*b*.

That is, both ends in the axial direction of a part of the cylinder 21 that configures the first compression mechanism 20*a* in the present embodiment are closed with the first side plate 25*a* and the intermediate side plate 25*c*. Furthermore, both ends in the axial direction of a part of the cylinder 21 that configures the second compression mechanism 20*b* are closed with the second side plate 25*b* and the intermediate side plate 25*c*.

Although in the present embodiment, the cylinder 21 and the intermediate side plate 25*c* are integrally formed, obviously, the cylinder 21 and the intermediate side plate 25*c* may be formed of separate members and be integrated together by means, such as press-fitting.

The shaft 24 is a substantially cylindrical member that rotatably supports the cylinder 21 (specifically, the respective side plates 25*a*, 25*b*, and 25*c* fixed to the cylinder 21), the first rotor 22*a*, and a second rotor 22*b* configuring the second compression mechanism 20*b*.

An eccentric portion 24*c* is provided at the center in the axial direction of the shaft 24, and has a smaller outer diameter than that of an end of the shaft 24 on the sub-housing 12 side. A central axis of the eccentric portion 24*c* (hereinafter referred to as an "eccentric axis C2") is disposed eccentrically relative to the central axis C1 of the cylinder 21. The eccentric portion 24*c* rotatably supports the first and second rotors 22*a* and 22*b* via a bearing mechanism (not shown). Thus, during rotation, the first and second rotors 22*a* and 22*b* rotate around the eccentric axis C2 that is eccentric to the central axis C1 of the cylinder 21.

As shown in FIG. 1, a shaft-side suction passage 24*d* is formed within the shaft 24 to communicate with the housing-side suction passage 13*a* and to guide the low-pressure refrigerant flowing thereinto from the outside to the side of the first and second compression chambers Va and Vb.

A plurality of (four in total in the present embodiment) of first and second shaft-side outlets 240*a* and 240*b* are opened at the outer peripheral surface of the shaft 24 to flow out a low-pressure refrigerant circulating through the shaft-side suction passage 24*d*. The first and second shaft-side outlets 240*a* and 240*b* are arranged at equal angular intervals to each other as viewed from the axial direction of the eccentric axis C2.

As shown in FIGS. 1 and 4, first and second shaft-side concave portions 241*a* and 241*b* are formed at the outer peripheral surface of the shaft 24 by recessing the outer peripheral surface of the shaft 24 toward its inner peripheral side. The first and second shaft-side outlets 240*a* and 240*b* are opened in positions where the first and second shaft-side concave portions 241*a* and 241*b* are formed, respectively.

Thus, the first and second shaft-side outlets 240*a* and 240*b* communicate with first and second shaft-side communication spaces 242*a* and 242*b* formed in the first and second shaft-side concave portions 241*a* and 241*b*.

The first rotor 22*a* is a cylindrical member disposed in the cylinder 21, and extending in the central axial direction of the cylinder 21. As shown in FIG. 1, the length in the axial direction of the first rotor 22*a* is substantially equal to that in the axial direction of the part configuring the first compression mechanism 20*a* included in the shaft 24 and cylinder 21.

The outer diameter of the first rotor 22*a* is set smaller than the inner diameter of a columnar space formed in the cylinder 21. More specifically, as illustrated in FIG. 2, the outer diameter of the first rotor 22*a* is set such that the outer peripheral surface of the first rotor 22*a* comes into contact with the inner peripheral surface of the cylinder 21 at one contact point C3 as viewed from the axial direction of the eccentric axis C2.

Power transmission devices are provided between the first rotor 22*a* and the intermediate side plate 25*c* and between the first rotor 22*a* and the first side plate 25*a* to transmit a rotational driving force to the first rotor 22*a* from the intermediate side plate 25*c* and first side plate 25*a*, which rotate along with the cylinder 21.

More specifically, as shown in FIG. 2, the power transmission device provided between the first rotor 22*a* and the intermediate side plate 25*c* includes a plurality of (four in the present embodiment) circular holes 221*a* formed at the surface of the first rotor 22*a* on the intermediate side plate 25*c* side, and a plurality of (four in the present embodiment) drive pins 251*c* fixed to the intermediate side plate 25*c*.

Each of the drive pins 251*c* is formed to have a smaller diameter than a hale 221*a*. The drive pins 251*c* protrude toward the rotor 22 side in the axial direction to be fitted into the respective holes 221*a*. In this way, the drive pins 251*c* and the holes 221*a* configure a mechanism equivalent to the so-called pin-hole anti-rotation mechanism. The same goes for the power transmission device provided between the first rotor 22*a* and the first side plate 25*a*.

In the power transmission devices of the present embodiment, when the cylinder 21 rotates around the central axis C1, the relative position (or relative distance) of each drive pin 251*c* to the eccentric portion 24*c* of the shaft 24 changes. Because of the change in the relative position (or relative distance), the sidewall surface of each hole 221*a* of the first rotor 22*a* receives a load from the corresponding drive pin 251*c* in the rotation direction. The first rotor 22*a* rotates around the eccentric axis C2 in synchronization with the rotation of the cylinder 21.

In the power transmission device of the present embodiment, the plurality of the drive pins 251*c* and the holes 221*a* sequentially transmits the power to the rotor 22. Therefore, the drive pins 251*c* and the holes 221*a* are desirably arranged at equal angular intervals around the eccentric axis C2. To suppress the wear of the sidewall surface of the hole 221*a*, a ring member for preventing the wear or the like may be disposed at the sidewall surface of the hole 221*a*.

As shown in FIGS. 2 and 3, a first groove (first slit) 222*a* is formed at the outer peripheral surface of the first rotor 22*a* so as to be recessed toward the inner peripheral side across the entire area in the axial direction of the first rotor. The first vane 23*a* to be described later is slidably fitted into the first groove 222*a*.

In the first groove 222*a*, the surface along which the first vane 23*a* slides (friction surface with the first vane 23*a*) is inclined with respect to the radial direction of the first rotor 22*a* as viewed from the axial direction of the eccentric axis C2. In more detail, the surface of the first groove 222*a* along which the first vane 23*a* slides is inclined in the rotation direction from the inner peripheral side to the outer peripheral side. Thus, the first vane 23*a* fitted into the first groove 222*a* is also displaced in the direction inclined with respect to the radial direction of the first rotor 22*a*.

As shown in FIG. 3, a first rotor-side suction passage 224*a* is formed within the center in the axial direction of the first rotor 22*a* to be extended and inclined in the radial direction like the first groove 222*a* and to make the inner peripheral side of the first rotor 22*a* communicate with its outer peripheral side (the side of the first compression chamber Va).

As can be seen from FIG. 3, an outlet of the first rotor-side suction passage 224*a* is opened at the outer peripheral surface of the first rotor 22*a* on the rear side in the rotation direction with respect to the first groove 222*a*. The first rotor-side suction passage 224*a* and the first groove 222*a* are separated from each other and formed to avoid mutual communication between their internal spaces.

As shown in FIGS. 1 and 3, a first rotor-side concave portion 226*a* is formed at the inner peripheral surface of the first rotor 22*a* by recessing the inner peripheral surface of the first rotor 22*a* toward its outer peripheral side. As shown in FIG. 3, a first rotor-side inlet 225*a* of the first rotor-side suction passage 224*a* is opened at a part of the first rotor where the first rotor-side concave portion 226*a* is formed. The first rotor-side inlet 225*a* communicates with a first rotor-side communication space 227*a* formed within the first rotor-side concave portion 226*a*.

Figure 5:
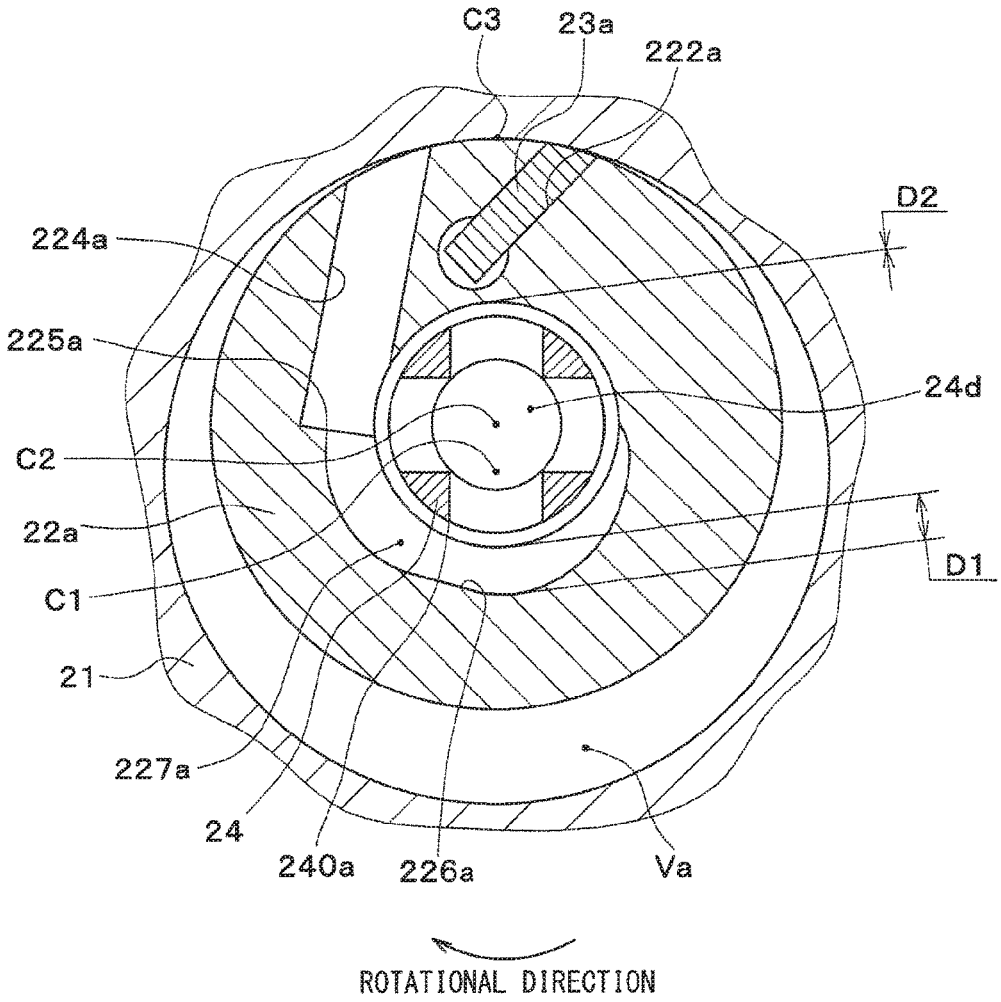
FIG. 5 is an enlarged cross-sectional view for explaining a depth dimension in the radial direction of a rotor-side concave portion in the one embodiment.
Figure 6:
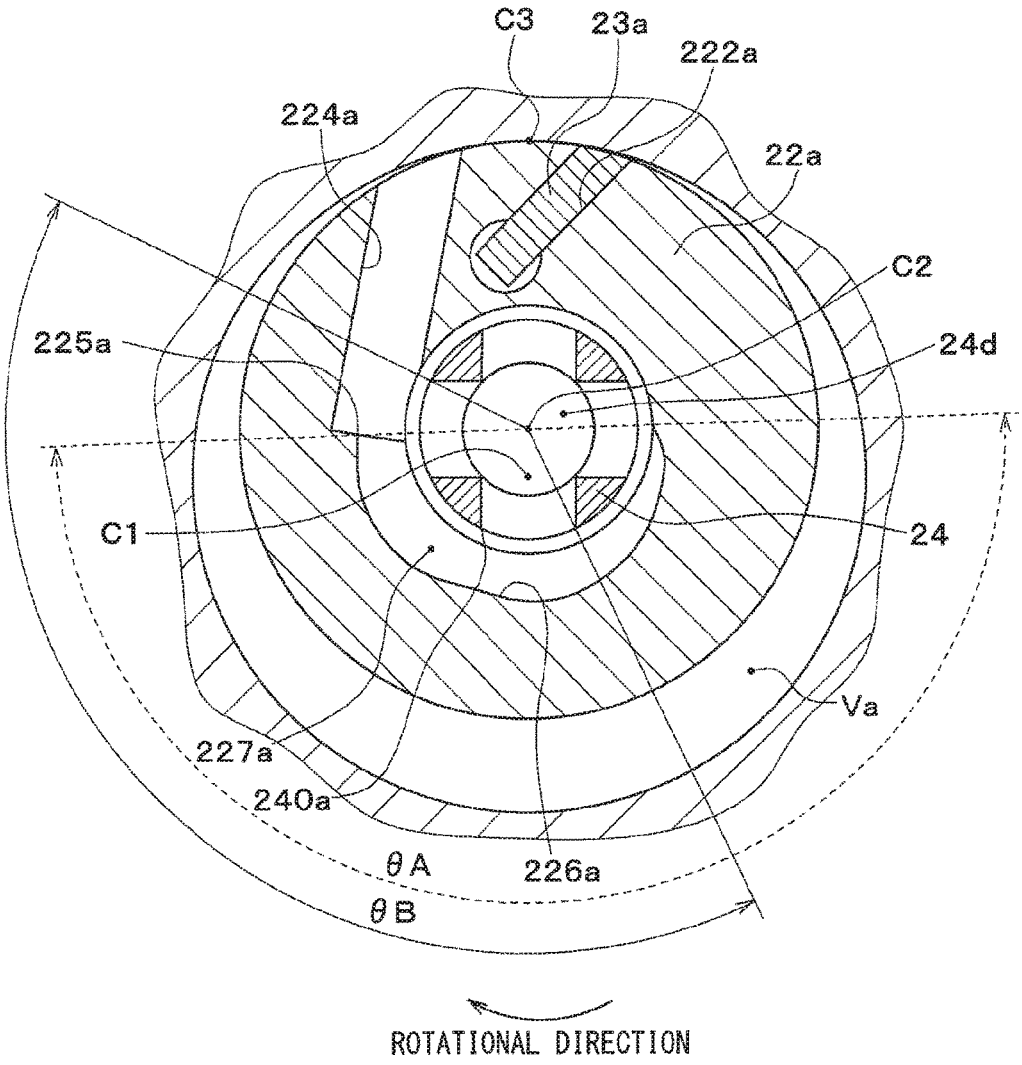
FIG. 6 is an enlarged cross-sectional view for explaining a formation angle range for the rotor-side concave portion in the one embodiment.

The detailed shapes of the first rotor-side concave portion 226*a* and the first rotor-side communication space 227*a* will be described with reference to FIGS. 5, 6. FIGS. 5 and 6 are enlarged diagrams showing the surroundings of the first rotor 22*a* shown in FIG. 3.

As shown in FIG. 5, the depth in the radial direction of the first rotor-side concave portion 226*a* is not a certain dimension around the axis of the first rotor 22*a*, but varies around the axis thereof as viewed from the axial direction of the first rotor 22*a* (i.e., in the axial direction of the eccentric axis C2). Further, in the present embodiment, the first rotor-side concave portion 226*a* is not formed in the vicinity of the first groove 222*a*. In other words, the first rotor-side concave portion 226*a* is not formed around the entire periphery of the eccentric axis C2.

Thus, as shown in FIG. 5, a depth D1 in the radial direction of a part of the first rotor-side concave portion 226*a* located farthest from the first groove 222*a* is deeper than a depth D2 (D2=0 in the present embodiment) in the radial direction of a part of the first rotor-side concave portion 226*a* located closest to the first groove 222*a*. With this arrangement, the first rotor-side communication space 227*a* and the internal space of the first groove 222*a* are separated from each other without communicating mutually.

As shown in FIG. 6, among angles formed around the eccentric axis C2 as viewed in the axial direction of the eccentric axis C2, a concave-portion formation angle θA is defined as an angle in a range where the first rotor-side concave portion 226*a* is formed, while a communication angle θB is defined as an angle formed between opening edges of the adjacent two shaft-side outlets 240*a* that are located farthest from each other.

In the present embodiment, the concave-portion formation angle θA and the communication angle θB are determined to satisfy formula F1 below.

$$\theta A > \theta B \quad \text{(F1)}$$

As shown in FIG. 1, the first rotor-side concave portion 226*a* is a part of the first rotor 22*a* located at its central side with respect to both ends in the axial direction of the first rotor 22*a* as viewed in the radial direction of the first rotor 22*a*. The first rotor-side concave portion 226*a* is formed to overlap with the range where the first shaft-side concave portion 241*a* is formed.

The first vane 23*a* is a plate-shaped partition member for partitioning the first compression chamber Va formed between the outer peripheral surface of the first rotor 22*a* and the inner peripheral surface of the cylinder 21. The length in the axial direction of the first vane 23*a* is substantially equal to that in the axial direction of the first rotor 22*a*. The tip end on the outer peripheral side of the first vane 23*a* is slidably disposed with respect to the inner peripheral surface of the cylinder 21.

Therefore, in the first compression mechanism 20*a* of the present embodiment, the first compression chamber Va is formed by a space enclosed with the inner wall surface of the cylinder 21, the outer peripheral surface of the first rotor 22*a*, the plate surface of the first vane 23*a*, the first side plate 25*a*, and the intermediate side plate 25*c*. That is, the first vane 23*a* partitions off the first compression chamber Va that is formed between the inner peripheral surface of the cylinder 21 and the outer peripheral surface of the first rotor 22*a*.

The first side plate 25*a* has a first discharge hole 251*a* formed therein to discharge the refrigerant compressed by the first compression chamber Va into the internal space of the housing 10. In the first side plate 25*a*, a first discharge valve made of a reed valve is disposed to prevent the refrigerant flowing out of the first discharge hole 251*a* into the internal space of the housing 10 from flowing back toward the compression chamber V via the first discharge hole 251*a*.

The second compression mechanism 20*b* has substantially the same basic structure as that of the first compression mechanism 20*a*. Therefore, as shown in FIG. 1, the second compression mechanism 20*b* includes the second rotor 22*b*, a second vane 23*b*.

A second rotor-side concave portion 226*b* or the like, which is substantially similar to the first rotor-side concave portion 226*a* of the first compression mechanism 20*a*, is formed on the inner peripheral surface of the second rotor 22*b*. A second rotor-side communication space 227*b*, which is substantially similar to the first rotor-side communication space 227*a*, is formed within the second rotor-side concave portion 226*b*.

In the second compression mechanism 20*b* of the present embodiment, the second vane 23*b*, the second discharge hole 251*b* of the second side plate 25*b* are arranged in positions shifted by 180 degrees in phase from the first vane 23*a* of the first compression mechanism 20*a*, the first discharge hole 251*a* of the first side plate 25*a*, respectively.

Figure 7:
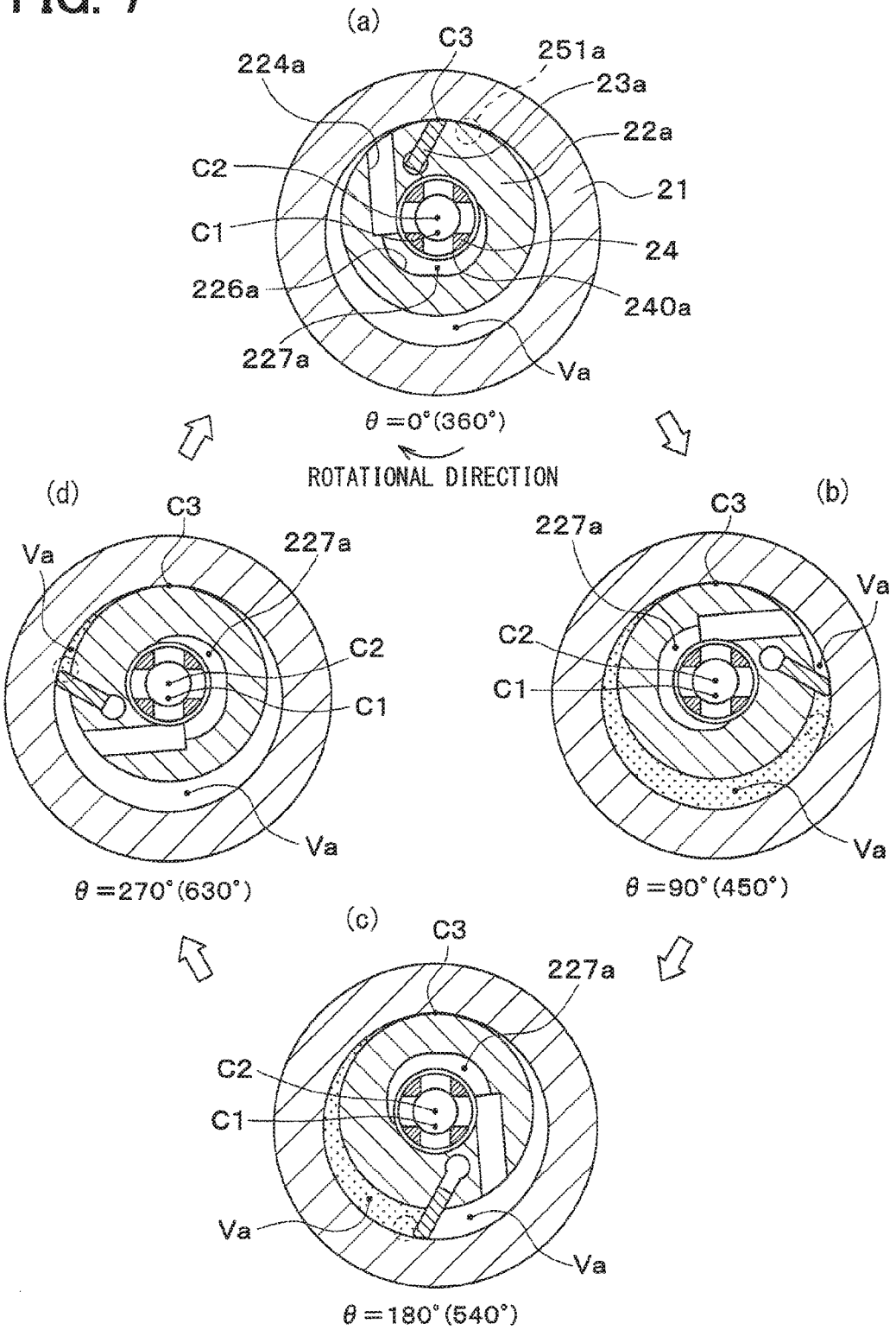
FIG. 7 is an explanatory diagram for explaining operating states of the compressor in the one embodiment.

Next, the operation of the compressor 1 in the present embodiment will be described with reference to (a), (b), (c), and (d) of FIG. 7. FIG. 7 explains operating states of the compressor 1, while continuously showing changes of the first compression chamber Va accompanied by the rotation of the cylinder 21.

The cross-sectional view corresponding to each rotational angle θ in FIG. 7 schematically illustrates the positions of the cylinder 21, the first rotor 22*a*, and the first vane 23*a*, which are shown in the equivalent cross-sectional view of FIG. 3. In FIG. 7, for clarification of the figures, reference characters for respective components are shown in the cross-sectional view corresponding to the rotational angle θ=0° of the cylinder 21.

As shown in FIG. 7(*a*), for the rotational angle θ of 0°, the contact point C3 overlaps with the tip end on the outer peripheral side of the first vane 23*a*. In this state, the first compression chamber Va with the maximum capacity is formed at the front side in the rotational direction of the first vane 23*a*, while the first compression chamber Va in a suction process with the minimum capacity (i.e., capacity of 0) is also formed at the rear side in the rotational direction of the first vane 23*a*.

The term "first compression chamber Va in a suction process" means the first compression chamber Va in a process where its capacity is expanding, while the term "first compression chamber Va in a compression process" means the first compression chamber Va in a process where its capacity is contracting.

With increasing rotational angle θ from 0°, as illustrated by the rotational angles θ=90° to 270° in FIG. 7, the cylinder 21, the first rotor 22*a*, and the first vane 23*a* are displaced to increase the capacity of the first compression chamber Va in the suction process formed at the rear side in the rotational direction of the first vane 23*a*.

Thus, the low-pressure refrigerant drawn from the suction port 12*a* formed in the sub-housing 12 flows through the housing-side suction passage 13*a*, the first shaft-side outlet 240*a* of the shaft-side suction passage 24*d*, the first shaft-side communication space 242*a* and first rotor-side communication space 227*a*, and the first rotor-side suction passage 224*a* in this order, and then flows into the first compression chamber Va in the suction process.

At this time, a centrifugal force generated by the rotation of the rotor 22 acts on the first vane 23*a*, so that the tip end on the outer peripheral side of the first vane 23*a* is pressed against the inner peripheral surface of the cylinder 21. With this arrangement, the first vane 23*a* separates the first compression chamber Va in the suction process and the first compression chamber Va in the compression process from each other.

Then, when the rotational angle θ reaches 360° (i.e., the rotational angle θ returns to 0°), the first compression chamber Va in the suction process takes the maximum capacity. Furthermore, when the rotational angle θ increases from 360°, the communication between the first rotor-side suction passage 224*a* and the first compression chamber Va in the suction process, which increases its capacity at the rotational angle θ=0° to 360°, is interrupted.

With this arrangement, the first compression chamber Va in the compression process is formed at the front side in the rotational direction of the first vane 23*a*.

As the rotational angle θ increases from 360° as shown by a dotted hatching at the rotational angles θ=450° to 630° shown in FIG. 7, the first compression chamber Va in the compression process formed at the front side in the rotational direction of the first vane 23*a* contracts its capacity (see (b), (c), and (d) of FIG. 7).

Thus, a refrigerant pressure in the first compression chamber Va in the compression process rises. When the refrigerant pressure in the first compression chamber Va exceeds a valve-opening pressure of a first discharge valve that is determined depending on a refrigerant pressure of an internal space of the housing 10, the refrigerant in the first compression chamber Va is discharged into the internal space of the housing 10 via the first discharge hole 251*a*.

As mentioned in the above description about the operations, to clarify the operating states of the first compression mechanism 20*a*, the changes in the first compression chamber Va at the rotational angles θ from 0° to 720° have been explained. In practice, the suction process of the refrigerant when the rotational angle θ changes from 0° to 360° and the compression process of the refrigerant when the rotational angle θ changes from 360° to 720° are simultaneously performed during one rotation of the cylinder 21.

The second compression mechanism 20*b* also operates in the same way to compress and draw the refrigerant. At this time, in the second compression mechanism 20*b*, the second vane 23*b* or the like is arranged in a position shifted by 180 degrees in phase from the first vane 23*a* of the first compression mechanism 20*a* and the like. Therefore, the second compression chamber Vb in the compression process compresses and draws the refrigerant at a rotational angle shifted by 180 degrees in phase with respect to the first compression chamber Va.

When the refrigerant pressure in the second compression chamber Vb in the compression process rises to exceed a valve-opening pressure of a second discharge valve disposed in the second side plate 25*b*, the refrigerant in the second compression chamber Vb is discharged into the internal space of the housing 10 via a second discharge hole 251*b*. The refrigerant flowing into the internal space of the housing 10 is merged with the refrigerant discharged from the first compression mechanism 20*a*, and the merged refrigerant is then discharged from the discharge port 11*a* of the housing 10.

In the refrigeration cycle device, the compressor 1 of the present embodiment can draw, compress, and discharge the refrigerant (fluid). In the compressor 1 of the present embodiment, the compression mechanism 20 is disposed on the inner peripheral side of the electromotor 30, thereby making it possible to downsize the entire compressor 1.

In the compressor 1 of the present embodiment, the suction passage for guiding the refrigerant drawn from the outside to the first compression chamber Va is formed by the shaft-side suction passage 24*d* and the first rotor-side suction passage 224*a*. Therefore, neither the passage structure nor the seal structure of the suction passage is complicated, as compared with the case in which a part of a suction passage is formed in the first side plate 25*a* or the like that rotates with the cylinder 21.

Meanwhile, in the compressor 1 of the present embodiment, the first shaft-side outlet holes 240*a* of the shaft-side suction passage 24*d* are opened at the outer peripheral surface of the shaft 24, while the first rotor-side inlet 225*a* is opened at the inner peripheral surface of the first rotor 22*a*.

Thus, a communication area that is effective in circulating the refrigerant from the first shaft-side outlet 240*a* to the first rotor-side inlet 225*a* tends to change, when the first rotor 22*a* rotates with respect to the shaft 24 to change the relative position of each first shaft-side outlet 240*a* to the first rotor-side inlet 225*a*. Furthermore, when the communication area becomes small, the loss of suction pressure in drawing the refrigerant into the first compression chamber Va might increase to degrade the pressurizing performance of the compressor 1.

In contrast, according to the compressor 1 in the present embodiment, the first rotor-side communication space 227*a* is formed within the first rotor-side concave portion 226*a*. Thus, even if the relative position of each first shaft-side outlet 240*a* to the first rotor-side inlet 225*a* changes together with the rotation of the first rotor 22*a*, the first shaft-side outlet 240*a* can communicate with the first rotor-side inlet 225*a* via the first rotor-side communication space 227*a*.

Since the outer diameter of the first rotor 22*a* is relatively larger than that of the shaft 24, the capacity of the first rotor-side communication space 227*a* can be easily formed to be larger than that of the first shaft-side communication space 242*a*. Therefore, the first rotor-side communication space 227*a* can be formed to have the capacity enough to appropriately communicate the first shaft-side outlets 240*a* with the first rotor-side inlet 225*a* without an increase in the entire size of the compressor 1.

Consequently, the compressor 1 in the present embodiment can suppress an increase in the loss of the suction pressure without increasing the entire size of the compressor 1.

The first rotor-side concave portion 226*a* does not need to be formed along the entire periphery of the inner peripheral surface of the first rotor 22*a* and can be shaped to have its depth in the radial direction varying around the axis thereof.

In the compressor 1 of the present embodiment, the depth D1 in the radial direction of the part of the first rotor-side concave portion 226*a* located farthest from the first groove 222*a* is deeper than the depth D2 in the radial direction of the part of the first rotor-side concave portion 226*a* located closest to the first groove 222*a*. In this way, the first rotor-side communication space 227*a* is separated from the internal space of the first groove 222*a*.

The refrigerant pressurized in the first compression chamber Va can be prevented from flowing back to the first rotor-side communication space 227*a* via the internal space of the first groove 222*a*. In this way, the shape of the first rotor-side communication space 227*a* can be set to one suitable for other applications, while ensuring the capacity required to appropriately make the first shaft-side outlets 240*a* communicate with the first rotor-side inlet 225*a*.

In the compressor 1 of the present embodiment, the first shaft-side communication space 242*a* is formed, in addition to the first rotor-side communication space 227*a*. Thus, the first shaft-side outlets 240*a* can communicate more appropriately with the first rotor-side inlet 225*a*, regardless of a change in the relative position of the first shaft-side outlet 240*a* to the first rotor-side inlet 225*a*.

At this time, the first shaft-side communication space 242*a* is auxiliarily used to enlarge the first rotor-side communication space 227*a*. Thus, there is no need to enlarge the depth in the radial direction of the first shaft-side concave portion 241*a* unnecessarily. Thus, the strength of the part where the first shaft-side concave portion 241*a* is formed might never become insufficient.

In the compressor 1 of the present embodiment, the first rotor-side concave portion 226*a* is formed in a position at the central side with respect to both ends in the axial direction of the first rotor 22*a*, as viewed from the radial direction of the first rotor 22*a*. Therefore, the shaft 24 can be configured to support both ends in the axial direction of the first rotor 22*a*. With this arrangement, when rotating the first rotor 22*a* around the shaft 24, the inclination of the first rotor 22*a* can be suppressed, so that the first rotor 22*a* can be rotated with good balance.

In the compressor 1 of the present embodiment, the concave-portion formation angle θA and the communication angle θB are determined to satisfy the above-mentioned formula F1. Thus, even if the relative position of the first shaft-side outlet 240*a* to the first rotor-side communication space 227*a* changes together with the rotation of the first rotor 22*a*, at least one opening area of the first shaft-side outlets 240*a* can communicate with the first rotor-side communication space 227*a*. Consequently, the compressor 1 in the present embodiment can more surely suppress an increase in the loss of the suction pressure.

In the description above, although the excellent effects exhibited by the compressor 1 in the present embodiment has been explained by taking the first compression mechanism 20*a*, the same effects can also be exhibited in the second compression mechanism 20*b*.

In the compressor 1 of the present embodiment, the compression and suction processes carried out by the first compression mechanism 20*a* are shifted by 180 degrees in phase from those by the second compression mechanism 20*b*. Therefore, variations in the total torque of the entire compressor 1 can be suppressed, as compared with a case in which the compression and suction processes are carried out in a first compression mechanism 20*a* at the same phases as those in a second compression mechanism 20*b*.

The term "variations in the total torque" as used herein means the sum of a torque variation generated by changes in the pressure of the refrigerant within the first compression chamber Va of the first compression mechanism 20*a* and another torque variation generated by changes in the pressure of the refrigerant within the second compression chamber Vb of the second compression mechanism 20*b*.

Other Embodiments

The present invention is not limited to the above-mentioned embodiment, and various modifications and changes can be made in the following way without departing from the scope and spirit of the present invention.

While in the above-mentioned embodiment, the cylinder rotary compressor 1 according to the present invention is applied to a refrigeration cycle of a vehicle air conditioner, the applications of the cylinder rotary compressor 1 are not limited thereto. That is, the cylinder rotary compressor 1 according to the present invention can be widely applied as a compressor that compresses a variety of fluids.

While the above-mentioned embodiment has described the cylinder rotary compressor of a system (slide plate type) that slides the tip end of the outer peripheral side of the first vane 23*a* along the inner peripheral surface of the first rotor 22*a*, the cylinder rotary compressor according to the present invention is not limited to this system. For instance, a cylinder rotary compressor of a system (swing plate type) can be employed that a fixing portion (hinge) formed at the tip end on the outer peripheral side of the first vane 23*a* is swingably supported by a groove formed at the inner peripheral surface of the first rotor 22*a*.

Although in the above-mentioned embodiment, the first and second shaft-side outlets 240*a* and 240*b* are arranged at equal angular intervals, the arrangement of the first and second shaft-side outlets 240*a* and 240*b* are not limited thereto. The first and second shaft-side outlets 240*a* and 240*b* may be arranged at non-uniform angular intervals depending on the degree of a change in the capacity of each of the first and second compression chambers Va and Vb corresponding to a change in its rotational angle θ.

In that case, for example, among angles formed around the eccentric axis C2 as viewed in the axial direction of the first rotor 22*a*, the communication angle θB is defined as the maximum angle formed between opening edges of the adjacent two first shaft-side outlets 240*a* that are located farthest from each other.

Although in the above-mentioned embodiment, a structure similar to the pin-hole anti-rotation mechanism is adopted as the power transmission device for the cylinder rotary compressor 1, the power transmission device is not limited thereto. A structure similar to an oldham ring anti-rotation mechanism may be adopted.

In the above-mentioned embodiment, the compression mechanism 20 is configured of two compression mechanism portions, namely, the first compression mechanism 20*a* and the second compression mechanism 20*b*. It is obvious that the compression mechanism 20 may be configured of one compression mechanism.

What is claimed is:

1. A cylinder rotary compressor comprising:

a cylindrical cylinder configured to rotate around a central axis;

a cylindrical rotor disposed in the cylinder and configured to rotate around an eccentric axis that is eccentric to the central axis of the cylinder;

a shaft rotatably supporting the rotor;

a vane slidably fitted into a groove provided in the rotor, the vane partitioning a compression chamber formed between an outer peripheral surface of the rotor and an inner peripheral surface of the cylinder;

a shaft-side suction passage provided within the shaft, in which a fluid to be compressed, flowing from an outside, is circulated;

an outlet of the shaft-side suction passage opened at an outer peripheral surface of the shaft;

a rotor-side suction passage provided within the rotor, through which the fluid to be compressed, flowing out of the outlet, is guided from an inner peripheral side of the rotor to the compression chamber;

a rotor-side concave portion provided at an inner peripheral surface of the rotor by recessing the inner peripheral surface of the rotor toward an outer peripheral side of the rotor; and an inlet of the rotor-side suction passage opened at a part of the rotor, where the rotor-side concave portion is formed, to communicate with a rotor-side communication space that is provided within the rotor-side concave portion.

2. The cylinder rotary compressor according to claim 1, wherein the rotor-side communication space is separated from an internal space of the groove.

3. The cylinder rotary compressor according to claim 1, wherein a depth in a radial direction of the rotor-side concave portion varies around the axis as viewed from an axial direction of the rotor, and a depth in the radial direction of a part of the rotor-side concave portion located farthest from the groove is deeper than a depth in the radial direction of a part of the rotor-side concave portion located closest to the groove.

4. The cylinder rotary compressor according to claim 1, wherein a shaft-side concave portion is provided at the outer peripheral surface of the shaft by recessing the outer peripheral surface of the shaft toward an inner peripheral side of the shaft, and the outlet is opened at a part of the shaft, where the shaft-side concave portion is formed, to communicate with a shaft-side communication space that is provided within the shaft-side concave portion.

5. The cylinder rotary compressor according to claim 1, wherein the rotor-side communication space is provided in a position at a central side with respect to both ends in an axial direction of the rotor, as viewed from a radial direction of the rotor.

6. The cylinder rotary compressor according to claim 1, wherein a plurality of the outlets is provided and a relationship below is satisfied:

$$\theta A > \theta B$$

in which among angles formed around an eccentric axis as viewed in an axial direction of the rotor, a concave-portion formation angle is defined as an angle in a range where the rotor-side concave portion is formed, and a communication angle is defined as a maximum angle formed between opening edges of the adjacent two outlets that are located farther from each other.

* * * * *